United States Patent [19]

Kasprzak et al.

[11] Patent Number: 4,767,548

[45] Date of Patent: Aug. 30, 1988

[54] ARTICLES FOR CONDITIONING FABRICS IN A LAUNDRY DRYER

[75] Inventors: Kenneth A. Kasprzak, Saginaw Township; Terence J. Swihart, Essexville; Andrew H. Ward, Sanford, all of Mich.

[73] Assignee: Dow Corning Corporation, Midland, Mich.

[21] Appl. No.: 893,752

[22] Filed: Aug. 6, 1986

[51] Int. Cl.[4] ..... D06M 11/15; D06M 13/46; D06M 13/52; D06M 15/643

[52] U.S. Cl. ..... 252/8.8; 252/8.6; 252/8.9; 427/242

[58] Field of Search ..... 252/8.6, 8.75, 8.8, 252/8.9, 174.15; 427/242

[56] References Cited

U.S. PATENT DOCUMENTS

| | | | |
|---|---|---|---|
| 3,562,786 | 2/1971 | Bailey | 252/174.15 |
| 3,895,128 | 7/1975 | Gaiser | 428/23 |
| 3,992,332 | 11/1976 | Zenon | 252/548 |
| 4,018,688 | 4/1977 | Pracht | 252/8.6 |
| 4,022,938 | 5/1977 | Zaki et al. | 427/242 |
| 4,233,164 | 11/1980 | Davis | 252/8.8 |
| 4,248,928 | 2/1981 | Spadini | 428/286 |
| 4,293,611 | 10/1981 | Martin | 428/266 |
| 4,297,406 | 10/1981 | Metcalf | 428/215 |
| 4,421,792 | 12/1983 | Rudy | 427/242 |
| 4,446,033 | 5/1984 | Barrat et al. | 252/8.6 |
| 4,559,151 | 12/1985 | Pregozen | 252/8.8 |
| 4,624,794 | 11/1986 | Cooke | 252/8.8 |
| 4,637,890 | 1/1987 | Crabtree | 252/90 |
| 4,639,321 | 1/1987 | Barrat | 252/8.8 |

FOREIGN PATENT DOCUMENTS 1549180 7/1979 United Kingdom .

*Primary Examiner*—Dennis Albrecht
*Attorney, Agent, or Firm*—Alexander Weitz

[57] ABSTRACT

Antistatic fabric softening articles comprising cationic fabric softening agents in combination with a polydiorganosiloxane component on a flexible substrate are described. The polydiorganosiloxane component may be a polydimethylsiloxane, a polyphenylmethylsiloxane, or a dimethylsiloxane-glycol copolymer. The fabric conditioning composition is releasably affixed or incorporated into a substrate from which it is transferred to fabrics in an automatic laundry dryer.

6 Claims, No Drawings

ARTICLES FOR CONDITIONING FABRICS IN A LAUNDRY DRYER

This invention relates to an article useful in the conditioning of fabrics in a laundry dryer. More particularly, it relates to fabric conditioning articles in the form of flexible substrates carrying a conditioning composition transferable to fabrics in a laundry dryer. Even more specifically, the invention relates to articles wherein the transferable conditioning composition contains a polydiorganosiloxane component mixed with a conventional cationic, fabric softening agent.

The use of fabric conditioning articles to impart softening, antistatic, lubricating, bacteriostatic, mildew-proofing or other desirable fabric conditioning effects in a laundry dryer is well known in the art. Typically, a flexible substrate carrying a conditioning composition is cotumbled with the moist fabrics in an automatic laundry dryer. The heat and tumbling action of the dryer helps to transfer the conditioning composition onto the fabric surfaces. Advantages of dryer added fabric conditioning include more convenient time of addition in the laundry process, provision of an optimal premeasured amount of conditioning composition, and avoidance of compatibility problems of softening agents with detergents.

Unfortunately, it has been observed that conventional softening agents such as the fatty alkyl substituted quaternary ammonium salts can stain fabrics if they are unevenly distributed during the drying process. On the other hand, some softening agents tend to adhere too strongly to the substrate so that they may be incompletely dispensed to the fabric during the drying cycle. Of course, less than complete transfer may require using excess softening material on the substrate to assure sufficient treatment of fabrics to effectuate the desired level of conditioning. Utilization of excess softening agent, besides being inefficient, may contribute to high, localized concentrations of softening agent being directly transferred to a fabric and causing a stain. Thus a need is recognized in the art to increase the evenness and completeness of the transfer of softening agent from the substrate to the fabric.

Various approaches have been taken in the art to obviate the above problems. For example, Zaki et al. in U.S. Pat. No. 4,022,938 teaches inclusion of minor amounts of fatty esters of sorbitan polyols into conventional fatty alkyl substituted quaternary ammonium salts to provide improved release of the softening composition from carrier substrates. It is further taught that the sorbitan materials provide auxiliary softening and antistatic treatment of fabrics in addition to that provided by the conventional cationic softener.

Silicones are known in the art for treating fabrics to provide various benefits such as water proofing, improved hand, and ironing ease. Silicones have primarily been applied to fabrics during manufacture or make-up of articles of clothing in the form of relatively concentrated dispersions or solutions using processes such as padding or spraying. In relation to conditioning fabrics during laundering, Dumbrell et al. in Great Britain Patent Specification No. 1,549,180 teach that fabrics can be provided with desirable overall conditioning effects by contact, during the rinse cycle, with dilute aqueous dispersions containing a mixture of a silicone of cationic character and a conventional cationic softening agent such as a fatty alkyl substituted ammonium salt. It is taught that silicones of cationic character such as linear dimethylsiloxanes prepared by emulsion polymerization with a cationic surfactant are more compatible with the conventional cationic softening agents and deposit more effectively from rinse baths to fabric surfaces.

A fabric softening composition containing emulsified silicone combined with conventional cationic softening agent is also taught by Barrat et al. in Example 1 of U.S. Pat. No. 4,446,033. Again the compositions are taught for use only during the aqueous rinse cycle of a laundry operation. Barrat et al. further teach that the addition of small amounts of amine functional silane such as N-(trimethoxysilylpropyl)ethylene diamine to fabric softening compositions will reduce corrosion of enamel washing machine surfaces.

SUMMARY OF THE INVENTION

It is an object of the invention to provide new articles adapted for providing fabric conditioning within an automatic laundry dryer. It is a further object to provide articles that more effectively and efficiently impart softening and antistatic benefits to fabrics.

The present invention relates to an article of manufacture adapted for providing fabric conditioning within an automatic laundry dryer. The article comprises a flexible substrate having a fabric conditioning amount of a conditioning composition affixed thereto in a manner which provides for release of the conditioning composition within an automatic laundry dryer at dryer operating temperatures.

The conditioning composition has a melting point above about 38° C., is flowable at dryer operating temperatures, and comprises (A) a cationic, fabric softening agent and (B) from about 0.1 to 15 percent by weight based on the fabric softening agent of a polydiorganosiloxane component having a viscosity from 20 to 10,000 cSt at 25° C. and selected from the group consisting of polydimethylsiloxanes, polyphenylmethylsiloxanes, and dimethylsiloxane-glycol copolymers.

DETAILED DESCRIPTION OF THE INVENTION

The articles of this invention are fashioned from conventional cationic fabric softening agents, certain polydiorganosiloxanes, and a flexible substrate. The cationic fabric softening agent and the polydiorganosiloxane are the essential components of the fabric conditioning composition which is dispensed to fabric from the article of this invention.

The fabric conditioning composition contains a major amount (generally from about 50 to 99.9 percent by weight) of a conventional cationic fabric softening agent and a minor amount (from about 0.1 to 15 percent by weight) of a polydiorganosiloxane. The polydiorganosiloxane improves the efficiency of fabric softening so that equivalent or improved softening effects can be obtained while using reduced amounts of cationic fabric softening agent. In addition, the polydiorganosiloxane unexpectedly provides an improved level of antistatic effect. Generally, the improvements are obtained even with low levels of the polydiorganosiloxane, so that it is preferred to use 0.2 to 2 percent by weight, based on the fabric softening agent, of the polydiorganosiloxane component.

The cationic agent of the fabric softening compositions of this invention can comprise any of the cationic (including imidazolinium) compounds listed in Zaki et al., U.S. Pat. No. 4,022,938, issued May 10, 1977, which is hereby incorporated by reference. Such materials are well known in the art and include, for example, the quaternary ammonium salts having at least one, preferably two, $C_{10}$ to $C_{22}$ fatty alkyl substituent; the alkyl imidazolinium salts wherein at least one alkyl group contains a $C_8$ to $C_{25}$ carbon chain; the $C_{12}$ to $C_{20}$ alkyl pyridinium salts; and the quaternary materials derived from fatty amidoamines.

Preferred cationic agents include the quaternary ammonium salts of the general formula $R^1R^2R^3R^4N^+X^-$, wherein $R^1$, $R^2$, $R^3$, and $R^4$ denote alkyl substituents and $X^-$ denotes an anion selected from halogen, acetate, phosphate, and methylsulfate. Cationic agents wherein $R^1$ and $R^2$ are each $C_{10}$ to $C_{22}$ fatty alkyl groups, $R^3$ and $R^4$ are each $C_1$ to $C_3$ alkyl groups, and $X^-$ is halogen or methylsulfate are especially preferred. The fatty alkyl group can be mixed, for example, the mixed $C_{14}$ to $C_{18}$ coconutalkyl and mixed $C_{16}$ to $C_{18}$ tallowalkyl quaternary compounds. Alkyl substituents $R^3$ and $R^4$ are preferably methyl groups.

Particularly useful quaternary ammonium fabric softening agents include ditallowdimethylammonium chloride, distearyldimethylammonium chloride, dipalmityldimethylammonium chloride, dicoconutalkyldimethylammonium chloride, ditallowdimethylammonium methylsulfate, distearyldimethylammonium methylsulfate, dipalmityldimethylammonium methylsulfate, and dicoconutalkyldimethylammonium methylsulfate.

For efficient operation of the articles of this invention, it is necessary that the conditioning composition substantially melt and flow at dryer operating temperatures of about 38° C. to 100° C. Such a melt-flow characteristic helps provide for transfer of the conditioning composition by contact with fabrics. Some cationic softeners are solids which do not exhibit optimal flow properties at dryer operating temperatures. However, it is known to mix certain organic nonionic surfactants with the cationic agents to lower the melting point range to within the optimal dryer operating temperature range. Consequently, it is within the scope of the present invention to optionally include nonionic organic surfactants along with the cationic agent in the conditioning composition to modify the melting point range or other property of the cationic agent.

The auxiliary efficiency/antistatic aids used in the present invention are polydiorganosiloxanes having a viscosity from 20 to 10,000, preferably 100 to 2,000, centistokes at 25° C. It has been found that useful polydiorganosiloxanes include the polydimethylsiloxanes, the polyphenylmethylsiloxanes, and the dimethylsiloxane-glycol copolymers.

Any polydimethylsiloxane or mixture of polydimethylsiloxane polymers having a viscosity within the specified range can be used in the present invention. Polydimethylsiloxanes are well known, commercially available polymers having a generally linear structure. The polymer chain may be terminated with triorganosiloxane groups, typically trimethylsiloxane, or by hydroxyl groups. The trimethylsiloxane terminated polydimethylsiloxanes are more preferred because they provide a more dramatic antistatic effect.

The polyphenylmethylsiloxanes are also well known, commercially available polymers having a generally linear structure. Useful polyphenylmethylsiloxanes include homopolymer of phenylmethylsiloxane units; copolymers of dimethylsiloxane and phenylmethylsiloxane units; copolymers of dimethylsiloxane and diphenylsiloxane units; and polymers containing dimethylsiloxane, phenylmethylsiloxane, and diphenylsiloxane units. Useful polyphenylmethylsiloxanes also include similar homopolymers and copolymers containing siloxane units having a phenyl and trimethylsilyloxy substituent on the silicon atom. Phenylmethylsiloxane polymers are generally terminated with triorganosiloxane units such as trimethylsiloxane, but also may be terminated by hydroxyl groups.

Dimethylsiloxane-glycol copolymers are also well known, commercially available polymers. For example, these copolymers are known as cosmetic ingredients wherein they are referred to under the generic nomenclature "dimethicone copolyol" from the *CTFA* (Cosmetic, Toiletry and Fragrance Association, Inc.) *Cosmetic Ingredient Dictionary.* Third Ed. 1982. Dimethylsiloxane-glycol copolymers are polymers of dimethylsiloxane units with one or more polyoxyethylene and/or polyoxypropylene chains substituted either randomly along the dimethylsiloxane chain or at the terminal positions of the dimethylsiloxane chain.

Any dimethylsiloxane-glycol copolymer having a viscosity within the specified range can be used in the present invention. For instance, copolymers can be used wherein the oxyalkylene chains are attached to the dimethylsiloxane by either oxygen to silicon bonds or by carbon to silicon bonds. However since carbon to silicon bonds are hydrolytically more stable, it is preferred to employ copolymers wherein the oxyalkylene chains are attached by carbon to silicon bonds. For example, the oxyalkylene chain may be attached through an alkylene bridge such as trimethylene which is substituted for one of the methyl groups of the dimethylsiloxane chain.

Particularly useful dimethylsiloxane-glycol copolymers include the copolymers generally represented by the average formulas:

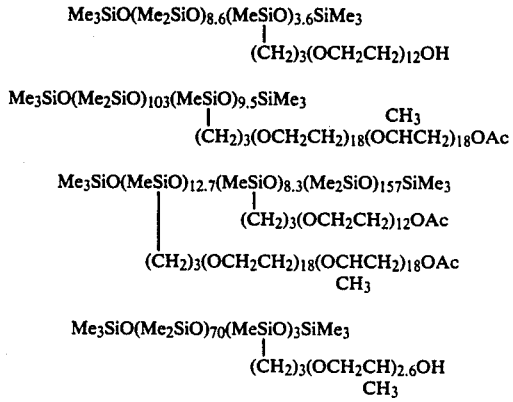

wherein Me denotes a methyl group and Ac denotes an acetyl group.

Any flexible substrate which effectively releases the conditioning composition in an automatic clothes dryer can be used in the present invention. For example, useful flexible substrates are listed and described in detail in Zaki et al., U.S. Pat. No. No. 4,022,938, issued May 10, 1977, which is hereby incorporated by reference. Briefly, appropriate substrates can be designed for single or multiple uses and can be provided in sponge or sheet conformations.

The sheet conformation has several advantages and is preferred. For example, effective amounts of the mixed conditioning compositions for use in conventional dryers can be easily sorbed onto and into the sheet substrate by a simple dipping or padding process. Thus, the user need not measure the amount of conditioning mixture necessary to obtain fabric softness and other benefits. Additionally, the flat configuration of the sheets provides a large surface area which results in efficient release of the conditioning materials onto fabric by the tumbling action of the dryer.

Substrates can have a dense, or more preferably, open or porous structure. Preferred substrate materials include paper, woven cloth, and nonwoven cloth. Generally the more preferred substrate materials have absorbent capacities of 4 to 12 times their own weight of water.

The amount of conditioning composition affixed to the flexible substrate may be varied widely depending on the size of the substrate and the degree of fabric conditioning desired. Typically it has been found advantageous to employ a weight ratio of conditioning composition to substrate in the range of 0.2:1 to 5:1.

Conditioning composition can be applied to the substrate by any of the commonly used processes such as dipping, padding, and spraying. The conditioning composition is preferably applied in liquid form to the substrate. Thus, components of the conditioning compositions which are normally solid at room temperature should first be melted and/or solvent treated with a liquid carrier. Known methods for melting and or dissolving cationic fabric softening agents can also be used with the conditioning compositions of this invention.

Following application of the liquified conditioning composition, the articles are typically held at room temperature until any solvent evaporates and the conditioning composition substantially solidifies. Sheet articles can optionally be slitted or punched at any convenient time during the manufacturing process to reduce any air flow blocking tendency of the articles.

Various additives can be used in combination with the cationic agent/polydimethylsiloxane component mixtures of the present invention. Although not essential to the present invention, certain fabric treating additives are particularly desirable and useful, for example, perfumes, brightening agents, shrinkage controllers, spotting agents, and the like. The amounts of fabric treating additives that are used are usually small, being in the range of from 0.01 to 10 percent by weight of the total conditioning composition.

Liquids which serve as carrier for the conditioning components and act to facilitate the application and impregnation of the conditioning composition onto the substrate can also be employed. Preferably, such a carrier liquid is inert or stable with the conditioning components and readily volatile at room temperature so that a nonflowing and nonsticky residue of conditioning components is provided on the substrate. Liquid carriers can be used in substantial amounts up to 50 percent or higher as needed to liquify the conditioning components.

The incorporation of the polydimethylsiloxane component in the conditioning composition used on the articles of this invention provides a surprising improvement in the antistatic benefits obtained during the dryer conditioning of fabrics. Another advantage of the present articles is that less conditioning composition can be used per article without reducing the level of softening and other benefits provided to fabrics during the drying process.

The following examples are presented to illustrate the invention to those skilled in the art and should not be construed as limiting the invention, which is properly delineated in the appended claims. All proportions by parts or percents are by weight unless otherwise stated.

EXAMPLE 1

Fabric softening compositions were prepared by blending ditallowdimethylammonium chloride and a polydiorganosiloxane component in warm Stoddard solvent and mixing until uniform. Each solution of fabric softening components was applied to sheets of nonwoven, polyester cloth (1 gram, 8 inches by 10 inches) in sufficient amount to provide about 0.5 gram of softening components on the sheet after evaporation of the solvent. After drying, three uniformly spaced slits were cut into each sheet.

The polydiorganosiloxanes used in the fabric softening compositions were (A) a trimethylsiloxy terminated linear dimethylsiloxane polymer having a viscosity of 350 cSt at 25° C. and (B) a hydroxy terminated linear dimethylsiloxane polymer having a viscosity of about 80 cSt at 25° C. For comparison, a similar sheet was prepared containing only ditallowdimethylammonium chloride as the softening component.

The ability of the treated sheets to soften and condition fabrics in an automatic laundry dryer was tested according to the following procedure. A fabric bundle consisting of 3 to 4 kilograms of 86/14% cotton/polyester towels and 200 to 250 grams of 100% polyester fabric was washed with a heavy duty laundry detergent in an automatic washing machine using hot water and a normal cycle. The bundle and a treated sheet were placed in an automatic laundry dryer and tumbled for 70 minutes at the high temperature setting on the machine.

After drying, three towels were separated from the fabric bundle and the static charge measured using a Simco Electrostatic Locator. The static charge was measured at ten different locations on each towel and the 30 individual values were averaged to provide the average volts of static charge. The results are presented in Table 1. In each case, the presence of even 1 percent polydiorganosiloxane resulted in a substantial reduction in static charge.

TABLE 1

| Polydiorgano-Siloxane | Weight Percent* Polydiorganosiloxane | Average Volts of Static |
|---|---|---|
| A | 11 | 154 |
| A | 1 | 95 |
| B | 1 | 443 |
| None (Control) | 0 | 1100 |

*based on the weight of ditallowdimethylammonium chloride

EXAMPLE2

This example illustrates the reduction is static charge found on fabric conditioned by articles of the present invention wherein the softening composition affixed to the substrate contains a small amount of dimethylsiloxane-glycol copolymer mixed with the conventional cationic softener.

Fabric softening compositions containing ditallowdimethylammonium chloride and one of several dimethylsiloxane-glycol copolymers were prepared and applied to non-woven cloth sheets as described in Example 1. The dimethylsiloxane-glycol copolymers used in the fabric-softening compositions are generally represented by the average formulas as follows:

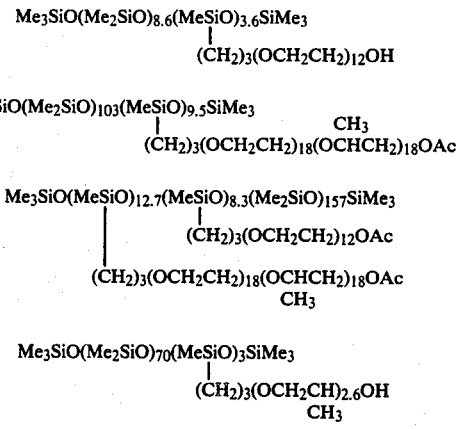

(C)

(D)

(E)

(F)

wherein Me denotes a methyl group and Ac denotes an acetyl group. Copolymers C, D, E, and F have viscosities at 25° C. of about 465, 1500, 1000, and 160 cSt respectively.

The ability of the treated sheets to soften and condition fabrics in an automatic laundry dryer was tested according to the procedure described in Example 1. The level of static charge that was observed on the fabrics after drying is shown in Table 2. For comparison, the level of static charge is also shown for the same fabric bundles dried with an equivalently treated sheet containing only ditallowdimethylammonium chloride. In each case, the presence of 1 percent of a dimethylsiloxane-glycol copolymer resulted in a substantial reduction in static charge relative to the control fabric which was conditioned with a sheet containing only ditallowdimethylammonium chloride.

TABLE 2

| Dimethylsiloxane Glycol Copolymer | Weight Percent* Copolymer | Average Volts of Static |
|---|---|---|
| C | 1 | 156 |
| D | 1 | 173 |
| E | 1 | 127 |
| F | 1 | 105 |
| None (Control) | 0 | 1100 |

*based on the weight of ditallowdimethylammonium chloride

What is claimed is:

1. An article of manufacture adapted for providing fabric conditioning within an automatic laundry dryer, the article consisting essentially of a flexible substrate having affixed thereto a fabric conditioning amount of a conditioning composition having a melting point above about 38° C. and being flowable at dryer operating temperatures, the composition comprising (A) a cationic, fabric-softening agent and (B) from about 0.2 to 11 percent by weight based on the fabric softening agent of a polydiorganosiloxane component having a viscosity from 80 to 2,000 cSt at 25° C. and selected from the group consisting of unsubstituted polydimethylsiloxane and unsubstituted polyphenylmethylsiloxanes, said composition being affixed to the substrate in a manner which provides for release of the conditioning composition within an automatic laundry dryer at dryer operating temperatures.

2. An article according to claim 1 wherein the cationic, fabric softening agent is as a quaternary ammonium salt having at least one alkyl substituent containing 10 to 22 carbon atoms.

3. An article according to claim 2 wherein the article is further characterized by having a weight ratio of conditioning composition to flexible substrate which ranges from 0.2:1 to 5:1.

4. An article according to claim 3 wherein the conditioning composition contains 0.2 to 2 percent by weight based on the fabric softening agent of the polydiorganosiloxane component.

5. An article according to claim 4 wherein the polydiorganosiloxane component has a viscosity of 100 to 2000 cSt at 25° C.

6. An article according to claim 5 wherein the polydiorganosiloxane component is a trimethylsiloxy terminated linear polydimethylsiloxane.

* * * * *